US007314399B2

(12) United States Patent
Turner

(10) Patent No.: US 7,314,399 B2
(45) Date of Patent: Jan. 1, 2008

(54) FLOATING SPORTSMAN'S BLIND

(75) Inventor: Hayes Brandon Turner, Lonoke, AR (US)

(73) Assignee: Banded Mallard Co., Lonoke, AR (US)

( * ) Notice: Subject to any disclaimer, the term of this patent is extended or adjusted under 35 U.S.C. 154(b) by 24 days.

(21) Appl. No.: 11/303,893

(22) Filed: Dec. 19, 2005

(65) Prior Publication Data

US 2007/0141925 A1 Jun. 21, 2007

(51) Int. Cl.
*B63C 9/08* (2006.01)

(52) U.S. Cl. ..... 441/129; 441/130; 441/131

(58) Field of Classification Search ..... 441/129–131
See application file for complete search history.

(56) References Cited

U.S. PATENT DOCUMENTS

| | | | | | |
|---|---|---|---|---|---|
| 161,874 | A | * | 4/1875 | Farmer | 310/75 B |
| 763,518 | A | * | 6/1904 | Tann | 441/131 |
| 1,743,333 | A | * | 1/1930 | Beckwith | 441/131 |
| 1,748,170 | A | * | 2/1930 | Chesnut | 441/131 |
| 1,764,852 | A | * | 6/1930 | Phillips | 441/131 |
| 2,075,374 | A | * | 3/1937 | Tucker | 441/131 |
| 2,173,963 | A | * | 9/1939 | Eubank | 441/131 |
| 2,207,025 | A | * | 7/1940 | Rison | 441/131 |
| 2,246,108 | A | * | 6/1941 | Sermon | 441/131 |
| 2,435,497 | A | * | 2/1948 | Hajduk | 441/131 |
| 2,958,876 | A | * | 11/1960 | Garrett | 441/131 |
| 2,959,796 | A | * | 11/1960 | De Sander et al. | 441/131 |
| 3,574,244 | A | * | 4/1971 | Huss | 441/131 |
| 3,748,672 | A | * | 7/1973 | Patrick et al. | 441/131 |
| 4,160,299 | A | * | 7/1979 | Hilbern | 441/131 |
| 4,601,667 | A | * | 7/1986 | Hull | 441/131 |
| 4,687,452 | A | * | 8/1987 | Hull | 441/131 |
| 4,799,910 | A | * | 1/1989 | Kellough | 441/131 |
| 4,833,813 | A | * | 5/1989 | McLemore, Jr. | 43/1 |
| 4,861,301 | A | * | 8/1989 | Pomeroy et al. | 441/131 |
| 4,973,278 | A | * | 11/1990 | Williams | 441/131 |
| 5,046,978 | A | * | 9/1991 | Howerton | 441/131 |
| 5,190,194 | A | * | 3/1993 | Rosner et al. | 224/0.5 |
| 5,295,885 | A | * | 3/1994 | Karl | 441/131 |
| 5,570,480 | A | * | 11/1996 | Yeung | 4/487 |
| 5,643,031 | A | * | 7/1997 | Fenton et al. | 441/130 |
| 5,987,661 | A | * | 11/1999 | Peterson | 4/506 |
| 6,010,382 | A | * | 1/2000 | Kennedy | 441/66 |
| 6,648,707 | B1 | * | 11/2003 | Peterson | 441/66 |
| 6,896,569 | B1 | * | 5/2005 | Wittenrich | 441/66 |
| 2006/0033674 | A1 | * | 2/2006 | Essig et al. | 343/912 |

* cited by examiner

*Primary Examiner*—Lars A. Olson
*Assistant Examiner*—Daniel V Venne
(74) *Attorney, Agent, or Firm*—Stephen D. Carver

(57) ABSTRACT

An improved float tube arrangement for outdoor water-related activities, particularly hunting and fishing. The float can be deployed as a blind for partially concealing and camouflaging a user, who sits in the circular middle of the float upon an adjustable seat supported by suitable straps. When used as a blind a canopy and net are selectively deployed. The stable base is formed by a pair of coaxially stacked inner tubes that are tightly bound by a covering fabric. Mechanical integrity is enhanced by frame loops encircling the inner tubes, and an encircling belt that concentrically tensions the float within a depressed region formed at the juncture of the stacked inner tubes. A canopy mounted to the frame loops and an optional net can be deployed as desired.

5 Claims, 15 Drawing Sheets

FLOATING SPORTSMAN'S BLIND

BACKGROUND OF THE INVENTION

1. Field of the Invention

The present invention relates generally to floats for supporting outdoorsman in the water. More particularly, the present invention relates to a floating support ideally used for hunting or fishing.

2. Description of the Related Art

Numerous recreational flotation devices used for water sports are disclosed in the prior art. Many use a circular or toroidal float, such as an automotive inner tube, for buoyancy. There are numerous recreational users of such floats, including hunters and fisherman, divers, and others interested in water sports. There are many different arrangements of harnesses, straps, and chair arrangements for seating the user in the middle of the float tube.

A typical user such as a fishermen, for example, might wear waterproof waders and, while seated within the tube, "float" a certain area or region that he or she is interested in fishing. The float tube is quite similar to an inflated rubber inner tube, but has a seat positioned in the open center of the tube in which the fisherman sits. The users legs and feet are suspended in the water beneath the float tube. A user might wear flippers on his or her feet for enhanced propulsion. Some of these devices include propulsion motors, although many users prefer to move themselves with their feet.

One common problem associated with normal inner tube floats relates to their height. Conventional floats with only one inner tube allow the seat to assume a fixed height above the water. This means that the user's lower body and a portion of the upper body will be submerged, limiting upper body movements. This can limit flexibility, interfering with casting or proper shooting. Additionally, by continually exposing much of the user's body to water, operator discomfort results, particularly with frigid conditions. It is thus desirable to provide a system where the seat can optionally be vertically raised. Achieving more height above the water is also desirable for equipment and equipment storage. Prior floats are impractical for using a gun because of the limited amount of supporting surface area and their limited height above the water. They offer limited or no dry storage due to this inadequacy.

Known inner-tube floats are typically uncomfortable and often lack adequate balance, and are therefore best used during extremely stable water conditions. In any event the user is often forced to grasp the frame of the float during difficult conditions for personal safety, making it difficult to control a rod or gun during fishing or hunting. Thus, most float designs are inadequate for safe, stable use during hunting or fishing, or for general use over fast-moving streams or rivers.

Besides the fact that typical inner-tube floats are structurally inadequate, particularly since they are not high enough, they are seldom rugged enough to withstand collisions with submerged objects. The structural weight and bulk of the protective materials necessary to "ruggedize" a float aggravates the instability of known designs. This flaw is partly caused by the inadequate frame arrangement in prior art designs that mounts the seat or harness to the circular inner tube. Moreover, some designs add structural protuberances to the radial periphery of the float, aggravating instability. Without an adequate frame or float design, for example, structural accessories such as rigid head or foot rests, or motor mounts tend to decrease stability.

Another problem with known prior art floats is that none appear optimized for hunting or fishing. Duck hunting conditions, for example, are often challenging. The hunter may find himself in shallow swampy, regions that adjoin unpredictable drop-offs. Sometimes rapid water flow is quite close to the hunting zone. The water may be cold and the weather may be harsh and difficult. During the hunt it is desirable to be protected from the elements. Also, there must be adequate space for the users guns or fishing rods to maneuver. Dry storage space must be provided for accessories and the usual equipment. Also important is the users comfort; during the long hours spent hunting for example, a significant advantage is realized by designs that afford the user adequate comfort.

There are several prior art floats using toroidal inner tubes, and many provide a seat from structure disposed over or about their middle. For example, U.S. Pat. No. 2,958,876 shows an inner tube with a seat harness disposed at its middle. A user may sit in the seat while floating. Similar variations of floats using inner tubes are seen in U.S. Pat. Nos. 2,075,374, 2,246,108, 2,529,961, and 3,324,488.

U.S. Pat. No. 4,795,387 discloses a collapsible inner tube seat insert.

U.S. Pat. No. 5,046,978 issued Jul. 27, 1993 discloses a float tube with an adjustable sling seat.

U.S. Design Pat. No. 363,753 issued Oct. 31, 1995 discloses a fishing harness for an inner tube.

U.S. Design Pat. No. D367,910 issued Mar. 12, 1996 discloses a flotation device for handicapped persons.

U.S. Pat. No. 4,938,722 issued Jul. 3, 1990 discloses a float system for fisherman that uses an inner tube. A battery operated trolling motor secured to the user's leg propels the float.

U.S. Pat. No. 5,230,646 issued Jul. 27, 1993 discloses a fisherman's float tube formed from a pneumatic inner tube. The tube has a seat at its center for supporting a person when floating.

U.S. Pat. No. 5,476,404 issued Dec. 19, 1995 discloses an inflatable recreational inner tube toy with a seat for the user. A plurality of structural straps extend across the interior and are coupled to the inner periphery. A back rest is formed from a smaller diameter secondary tube.

U.S. Pat. No. 5,643,031 issued Jul. 1, 1997 discloses a floating aquatic vehicle that seats a user while floating. The vehicle has a cover for encasing a buoyant float and a central opening for seating the user. A frame is coupled to the cover.

U.S. Pat. No. 5,779,512 issued Jul. 14, 1998 shows a safety floatation device that is mounted to the neck of the user. A small buoyant tube is concentrically joined to a larger buoyant tube. By comfortably and safely supporting the neck region above the surface of the water, the float inhibits movement of the spinal cord and reduces pressure thereto for relaxation and/or therapeutic purposes.

Of course a variety of hunting blinds, some of which are floating and mobile, exist. However, no known hunting blind combines the support and convenience of a suitable camouflaged blind, with the mobility and speed of a float tube. Notwithstanding the substantial diversity in the prior art, no float system known to me provides adequate stability for the serious hunter or fishermen. Besides offering stability, a useful and viable float system must be rugged and durable, and its weight and bulk must not detract from performance. For serious users, adequate float systems must offer an acceptable degree of comfort and personal safety. Finally, it is important that modern float designs aid the user in handling his gun or fishing rod and reel, and provide means for storing needed accessories and supplies while in use.

BRIEF SUMMARY OF THE INVENTION

This invention provides a stable and efficient floating hunting and fishing blind characterized by numerous advantages of value to the sportsman and/or outdoorsman.

My new improved float can be used for a variety of outdoor water-related activities, but it is primarily aimed at sportsman such as fisherman and hunters. In the best mode my new float is deployed as a blind for partially concealing and camouflaging the user. When used as a blind, optional canopy and net arrangement can be deployed as desired by the user.

Stability of the float is insured by the stacked or nested design of the various components. Preferably a pair of coaxial, stacked inner tubes that are tightly bound by a covering fabric form the base of the apparatus. Air bladders may be substituted for the inner tubes. The generally open circular center has a seat for the user, suspended between adjustable straps whose ends are permanently sewn to the fabric covering of the float. Mechanical integrity is enhanced by the combination of one or more frame loops that encircle the inner tubes, and a tight belt that concentrically encircles the periphery of the float.

The belt is seated over the fabric proximate a depressed region that is formed between the adjacent inner tubes. Both the encircling belt and the frame loops tension the covering fabric that enshrouds the float, increasing the mechanical strength of the float.

The canopy, deployed for shrouding and completing the blind, is preferably mounted over the body by attachment to the frame loops with suitable hardware. The attaching hardware, which can be wing nuts, knurled knobs or the like, threadably anchors a canopy support hoop over the float. An optional, see-through mesh net can be supported by the canopy hoop over the front of the float as well to aid in camouflaging the user, and to protect against insects.

Thus a basic object is to provide a highly durable and stable floating blind for hunting or fishing.

Another basic object is to provide an inflatable, recreational inner tube float that is highly stable and durable, and particularly adapted for use as a hunting or fishing blind.

A related object is to provide a float of the character described that can be controlled by the user with a minimum of effort.

A further object is to provide a float of the character described that is portable, and easily transported by the user.

Another simple object of the present invention is to buoyantly support a water-sports enthusiast.

Another object is to provide a float that it is stable and offers a wide range of height and size adjustments. It is a feature of the invention that the deployed size of the float can be adjusted by varying the amount of inflation. Further the seat is adjustable.

Yet another object is to provide a blind of the character described that resists snags by briars.

Another object of my invention is to offer a dry surface area for elbows, hands and equipment that is an adequate height above the water.

Yet another object is to provide a float of the character described that resists impact with submerged objects such as branches, rocks, debris and the like.

A basic object is to provide a float that can safely and reliably used while fishing, hunting, diving or engaging in other diverse water-sports or recreational activities.

It is another object of my invention to enhance operator comfort. It is a feature of my invention that creature comforts such as an adjustable headrest and gun support have been provided.

Yet another object of my invention is to provide a float of the character described that can shelter the user from wind, rain, snow, or other elements. Is an important feature of my design that an auxiliary, collapsible canopy may optionally be deployed.

Another object is to provide a camouflaged version which is especially adapted for duck hunting.

Yet another object is to provide a float design of the character described that can safely and reliably support and transport a variety of users of different sizes, ages, weights and heights.

These and other objects and advantages of the present invention, along with features of novelty appurtenant thereto, will appear or become apparent in the course of the following descriptive sections.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE INVENTION

Figure 1:
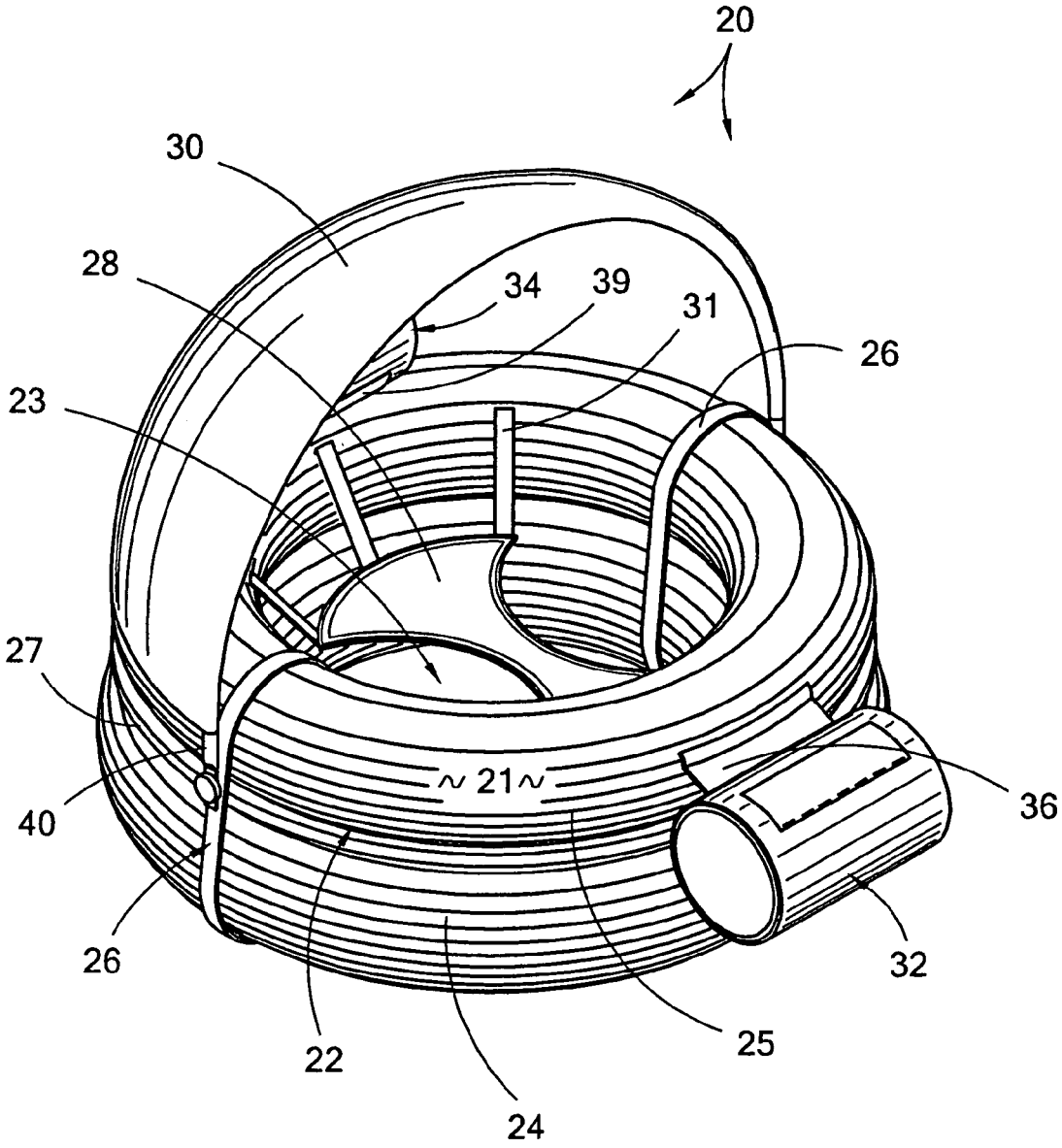
FIG. 1 is a frontal isometric view of my Floating Sportsman's Blind, with the canopy installed but the netting omitted for clarity.
Figure 2:
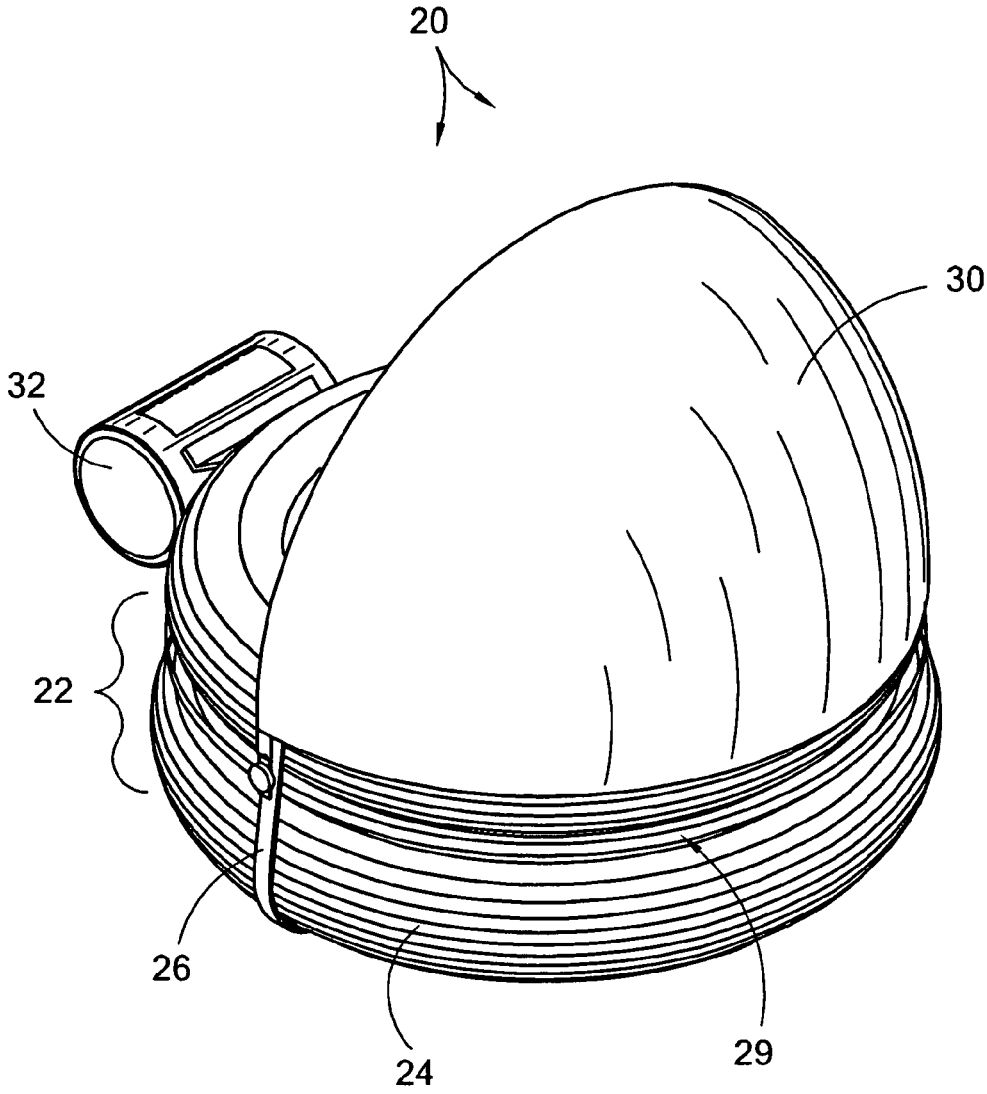
FIG. 2 is a rear isometric view of my blind, with the canopy installed.
Figure 3:
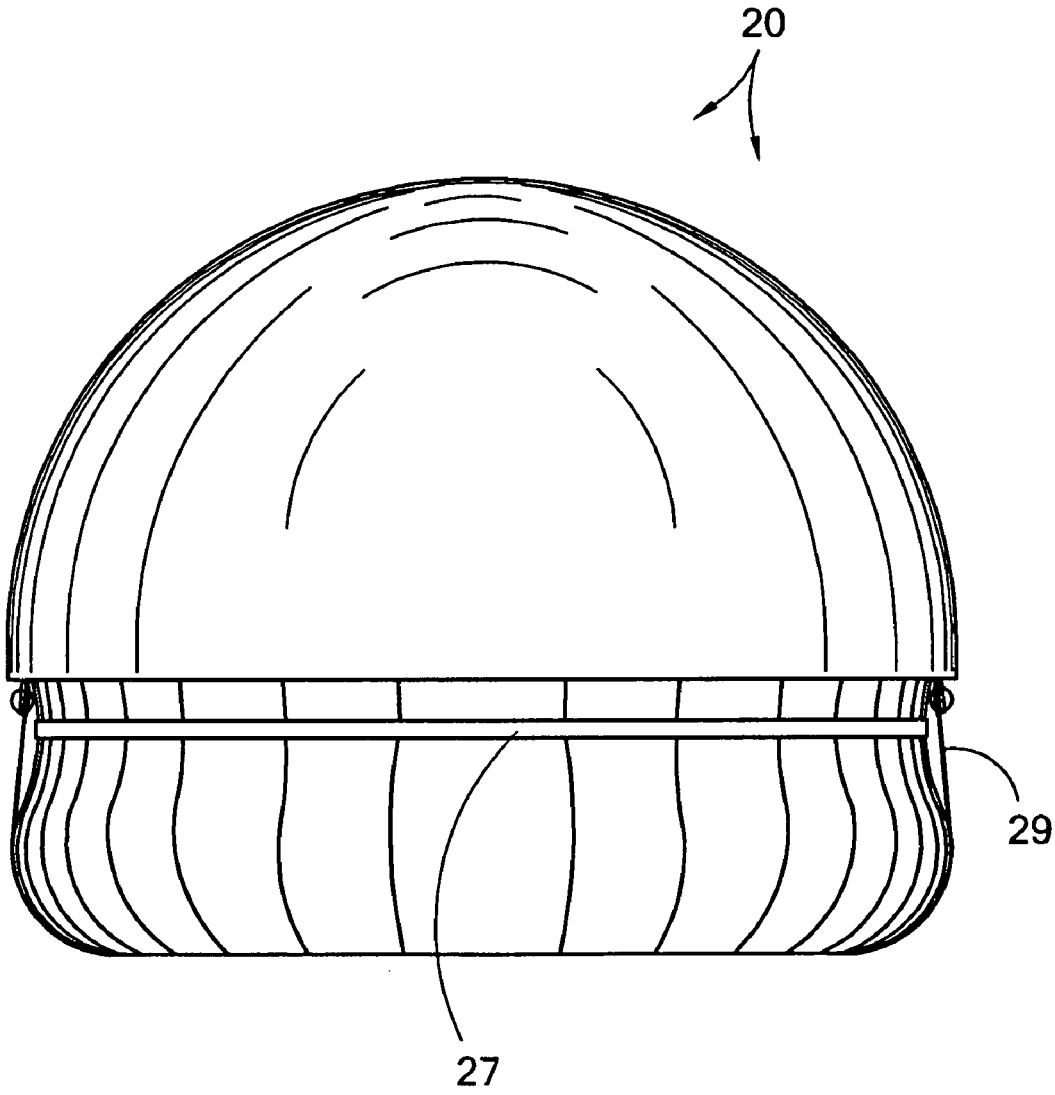
FIG. 3 is a rear elevational view of my blind, with the optional canopy deployed as in FIGS. 1 and 2.

With initial reference directed initially to FIGS. 1-3 of the appended drawings, my floating blind has been generally designated by the reference numeral 20. The lower, circular or toroidal base 22 of the float 20 preferably comprises a lower inner tube 24 and an upper inner tube 25 that are covered by suitable fabric and maintained in stacked, coaxial relation. The open and circular center of the aligned tubes and the float, generally designated by the reference numeral 23, is occupied by the user sitting on the seat 28 described below.

In the best mode the float has a base 22 formed from a pair of stacked inner tubes 24, 25 for flotation. Although automotive inner tubes are preferred in the best mode, a variety of other inflatable floats such as air bladders may be used. As used herein, the term "inner tube" shall refer to toroidal automotive inner tubes such as those illustrated, and to inflatable air bladders. The preferred inner tubes are vertically stacked, and arranged concentrically. A fabric covering 21 (FIGS. 10, 11) completely covers the inner tubes.

One or more frame loops 26 encircle the tubes 24, 25, to facilitate mounting of a collapsible canopy 30 with a canopy hoop 40. The frame structure is further enhanced by a belt 27 that is concentric and coaxial relative to the inner tubes 24, 25. The belt 27 is tightly seated within a depressed juncture region 29 formed between the stacked inner tubes, and it tensions the covering fabric 21 that completes the base and forms a frame. Belt 27 and frame loops 26 comprise suitable lengths of plastic or fabric materials, the ends of which are provided with conventional side release clamps for quick installation and removal. They are thus user installable, and they can be tensioned and quick-connected or disconnected as desired.

The removable canopy 30 is held over the canopy hoop 40 that is removably mounted to the frame loops 26. Canopy 30 is used when the float 20 is deployed as a blind, and it at least partially covers and shields the user. When desired, the canopy and its mounting hoop 40 can be removed, by either demounting the hoop 40 from the frame loops 26, or by unsnapping the frame loops 26 and removing them from the assembly.

Figure 6:
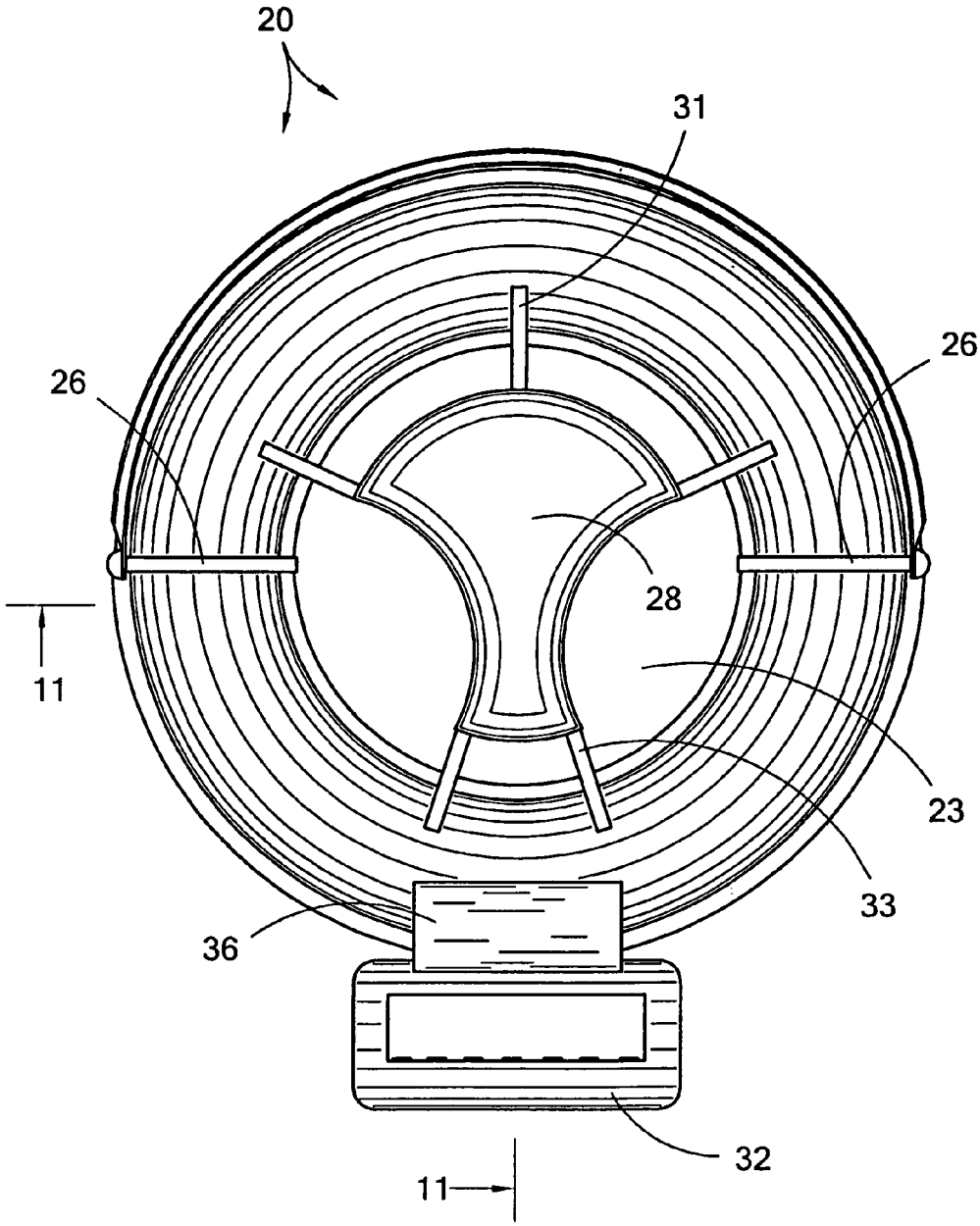
FIG. 6 is a vertical sectional view of my blind configured as in FIGS. 4 and 5, with portions thereof omitted for brevity and clarity
Figure 7:
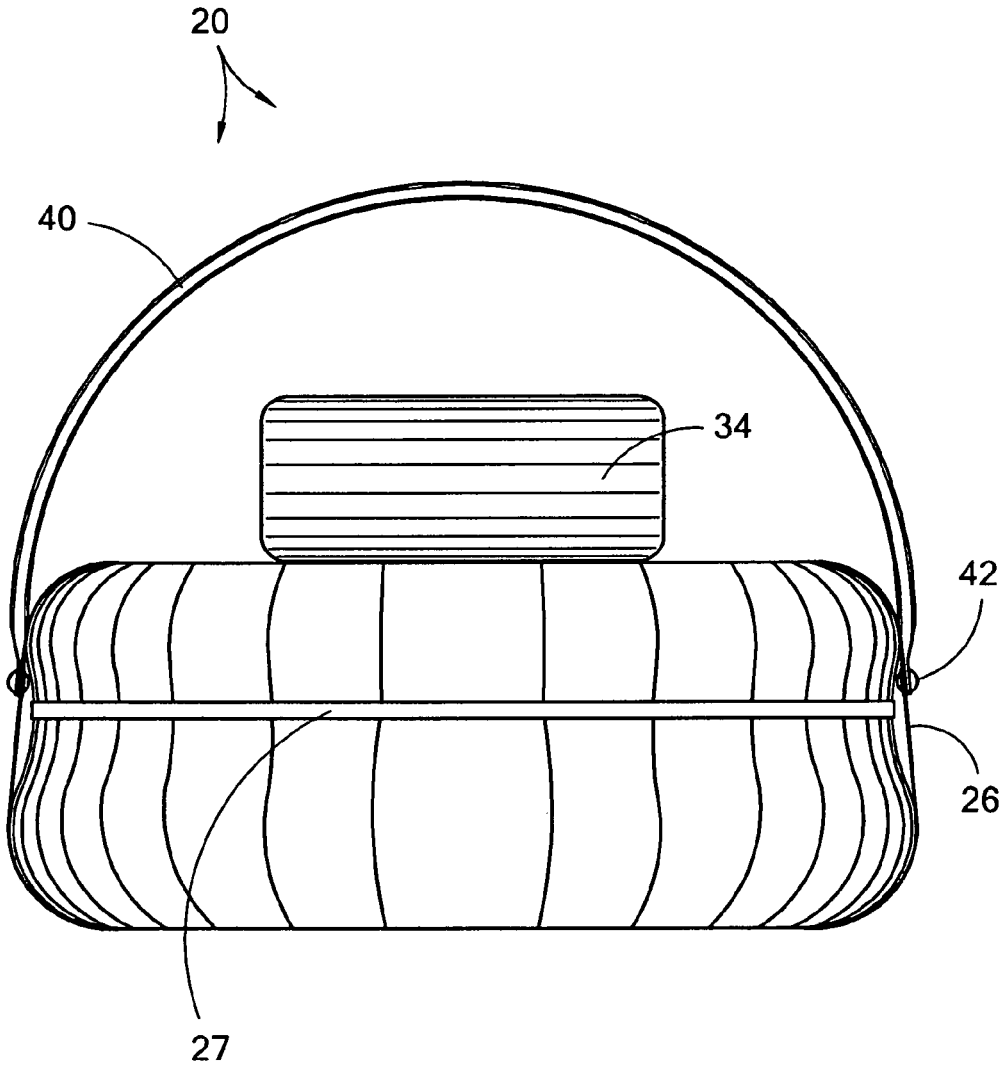
FIG. 7 is a rear elevational view, with the canopy omitted.

The circular center 23 is to be occupied by a user such as a hunter or fisherman. A fabric seat 28 is disposed within inner region, and it is stretched between various spaced-apart internal rear straps 31 and front straps 33 (i.e., FIG. 6) that are rigidly sewn to the external fabric covering of the float 20. The various spaced-apart internal straps 31, 33 provide flexibility and support. Straps 31 and 33 are preferably adjustable, so the user can effectively raise or lower the seat relative to the float. When the seat is lowered for hunting, the user gets deeper in the water, and he or she may be substantially immersed therein. Protective hunting gear such as waders would thus be recommended. When in shallow water a very stable position may thus be assumed, with the hunters feet touching bottom. When the straps are tightened, the height of the seat is raised, and less of the user's body will be submerged. In the latter mode, for example, a fisherman will have more upper clearance, and it will be easier to cast. He or she will also be warmer.

In the best mode, there is a generally cylindrical muzzle support 32 disposed at the front of the float 20. Support 32 is attached to the fabric 21 covering the inner tubes 24, 25 by a suitable flap 36 (FIGS. 1, 5, 6), that is permanently sewn to the float fabric. Support 32 is preferably located in front of the float 20, at a position about half way between the top of the upper inner tube 25 and the encircling belt 27 (i.e., FIG. 8). In such a position the top of the muzzle support 32 is approximately coplanar with the top of the upper float tube, thereby forming a surface extension that can support a long gun. Support 32 is covered by fabric 21. Preferably a conventional air bladder 37 (FIG. 11) of generally cylindrical dimensions (i.e., when inflated) is housed within support 32.

Figure 8:
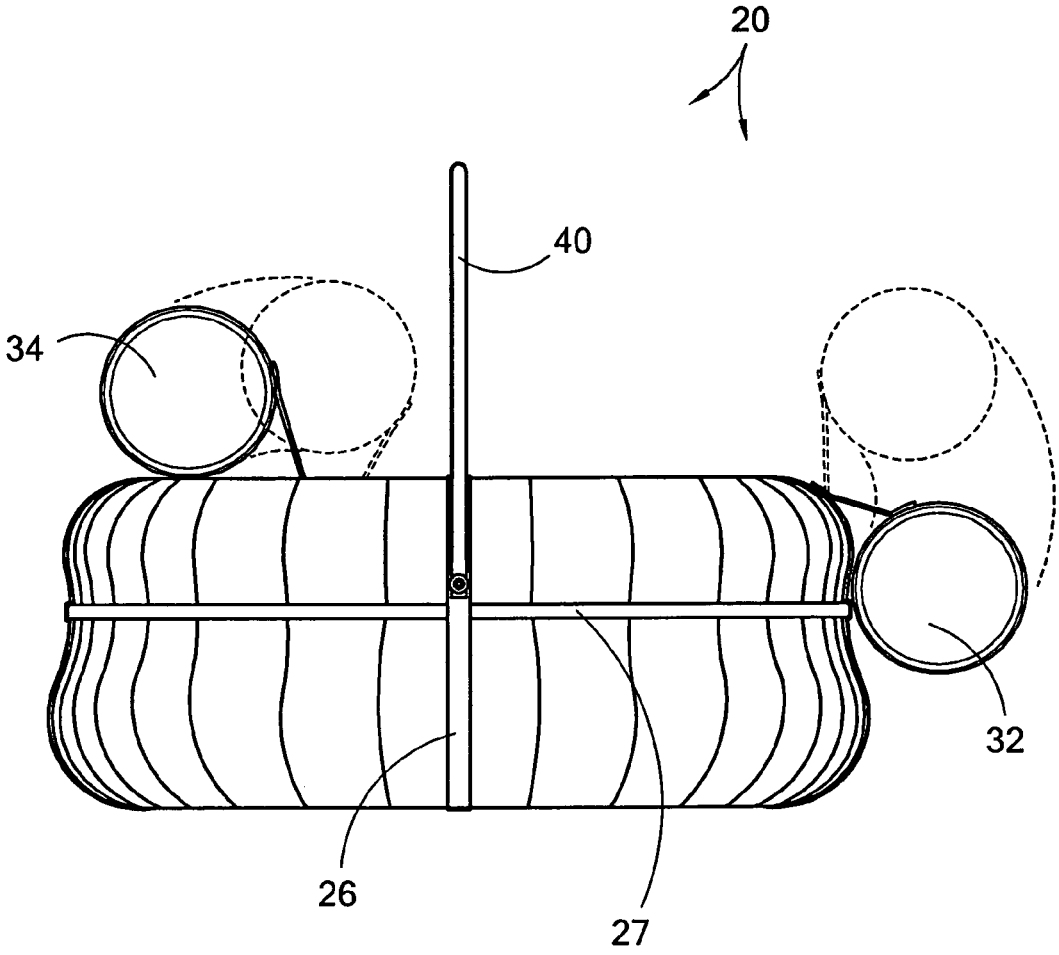
FIG. 8 is a right side elevational view with the canopy omitted, the left side view thereof comprising a mirror image.
Figure 9:
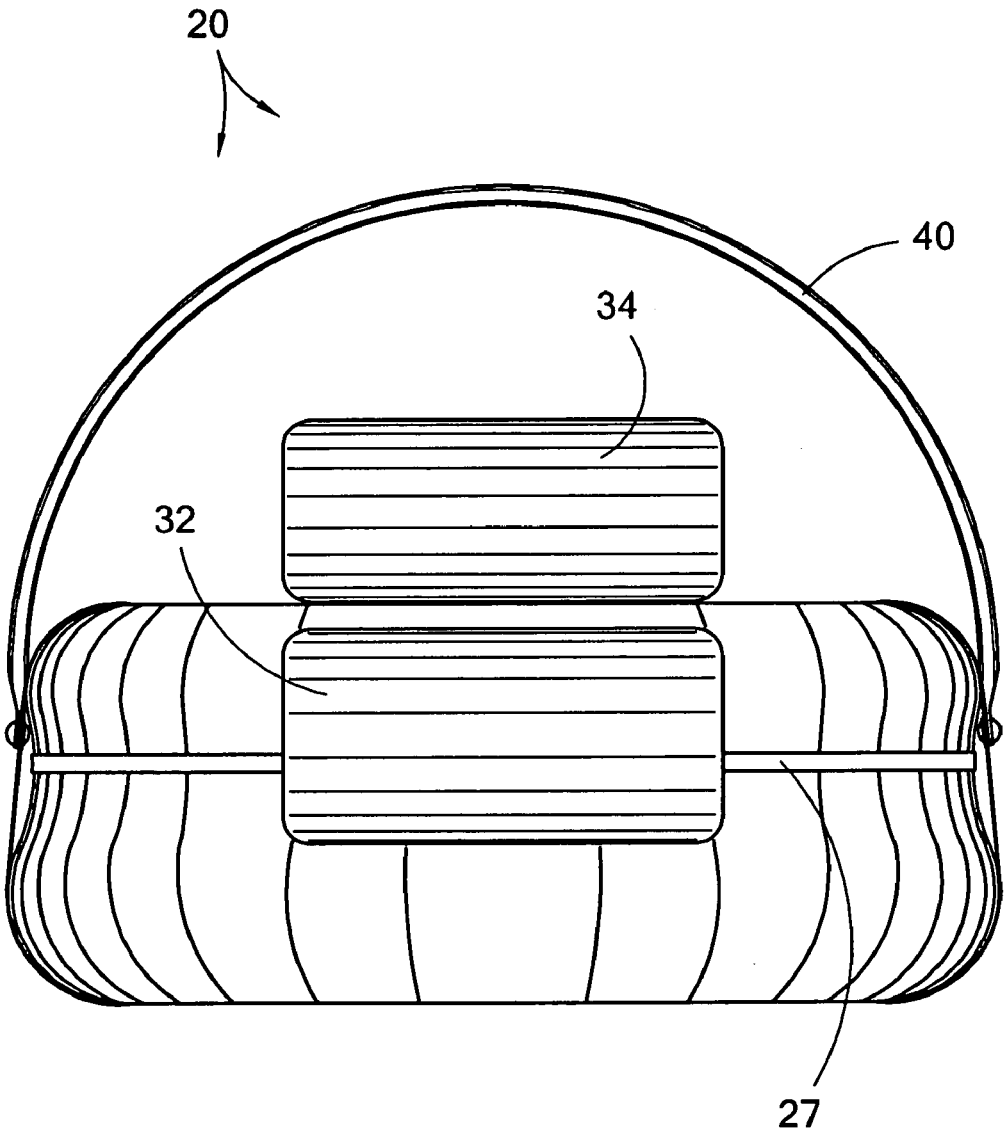
FIG. 9 is a front elevational view with the canopy omitted.

When support 32 assumes the stable, forwardly projecting gun supporting position illustrated in FIG. 1, it is conveniently accessible to the user, who can grasp and manipulate it with his or her hands. When desired, the support 32 can be swung into the interior of the float, simply by radially moving it into the float interior. As seen in FIG. 8, moved positions during said movement are shown in dashed lines. When the support 32 is radially moved into the interior, it cushions and brace the user against the front of the inner tubes. To "fit" the support 32 within the inner tubes, its air pressure can be dropped by bleeding the interior air bag.

Figure 4:
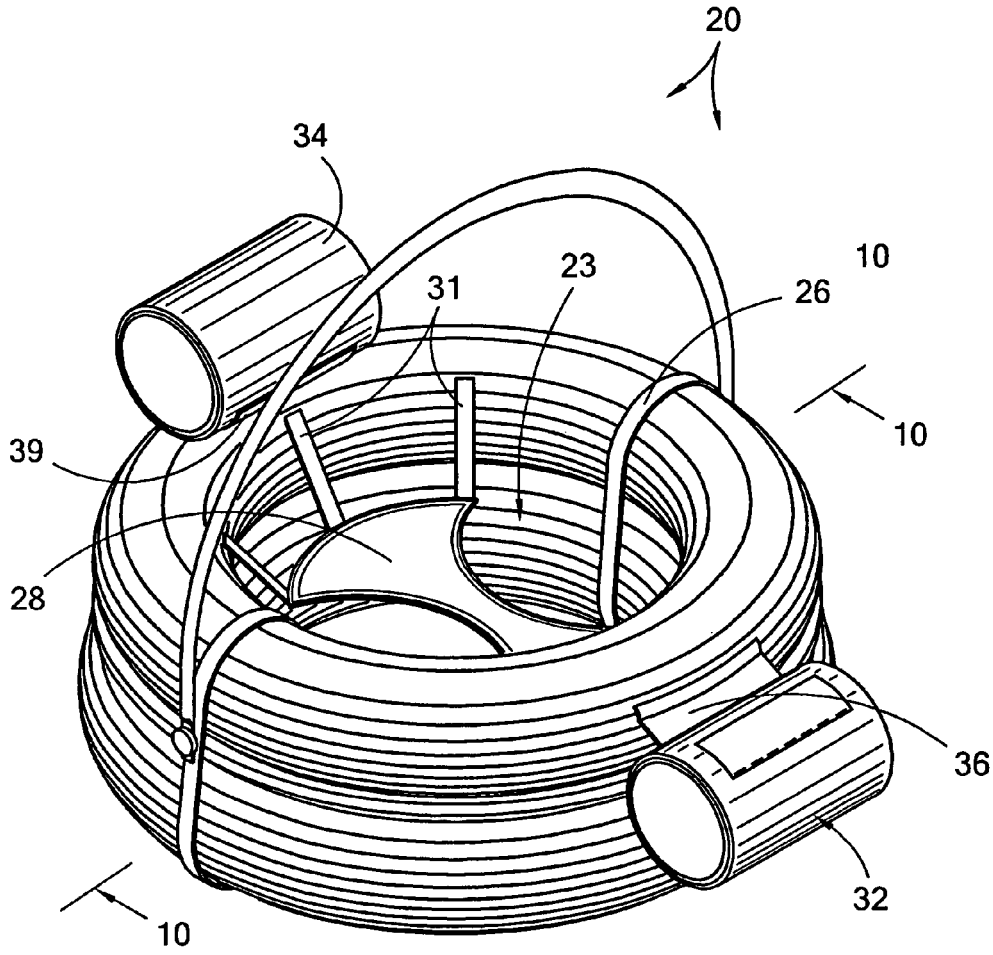
FIG. 4 is a frontal isometric view of my blind, with the canopy omitted for clarity.
Figure 10:
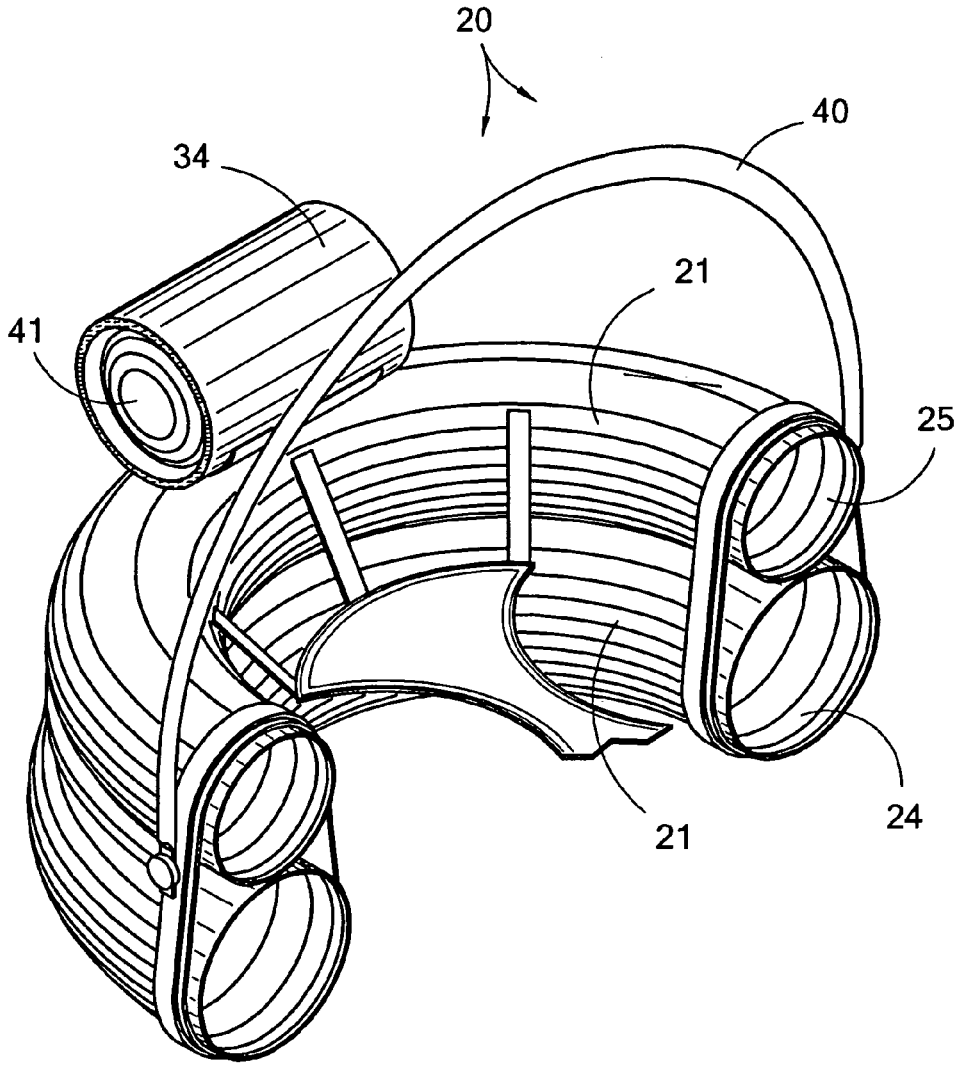
FIGS. 10 and 11 are enlarged, fragmentary sectional views.
Figure 11:
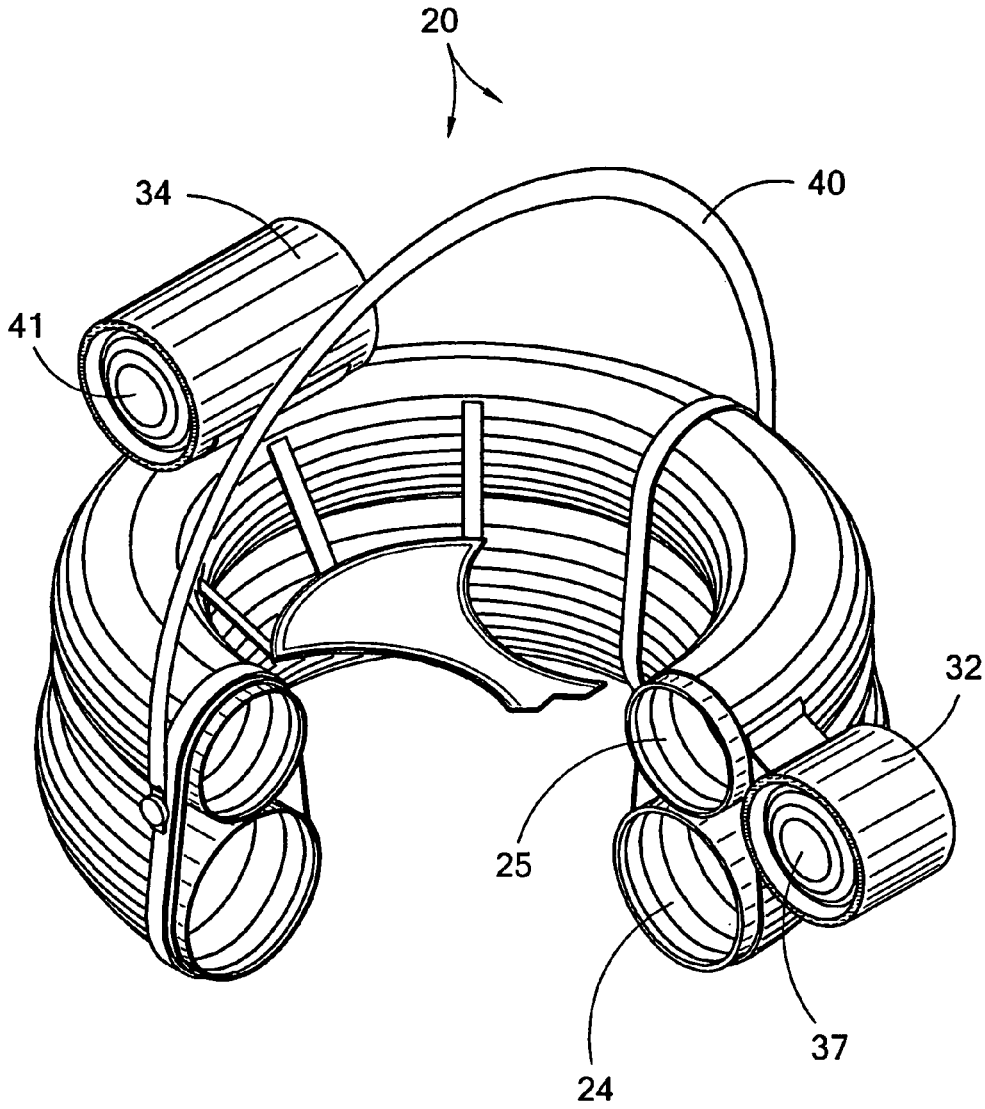
Figure 12:
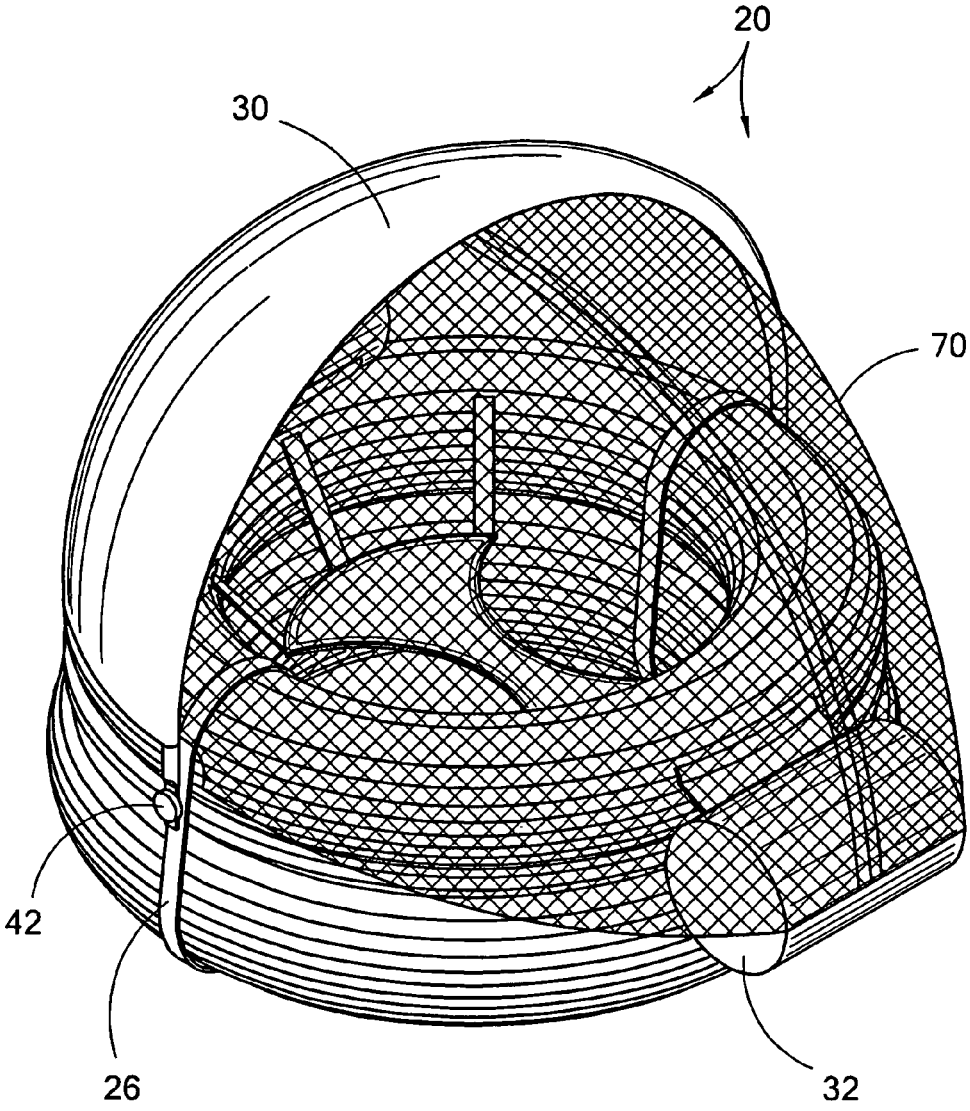
FIG. 12 is a frontal isometric view, with both the canopy and netting installed.
Figure 13:
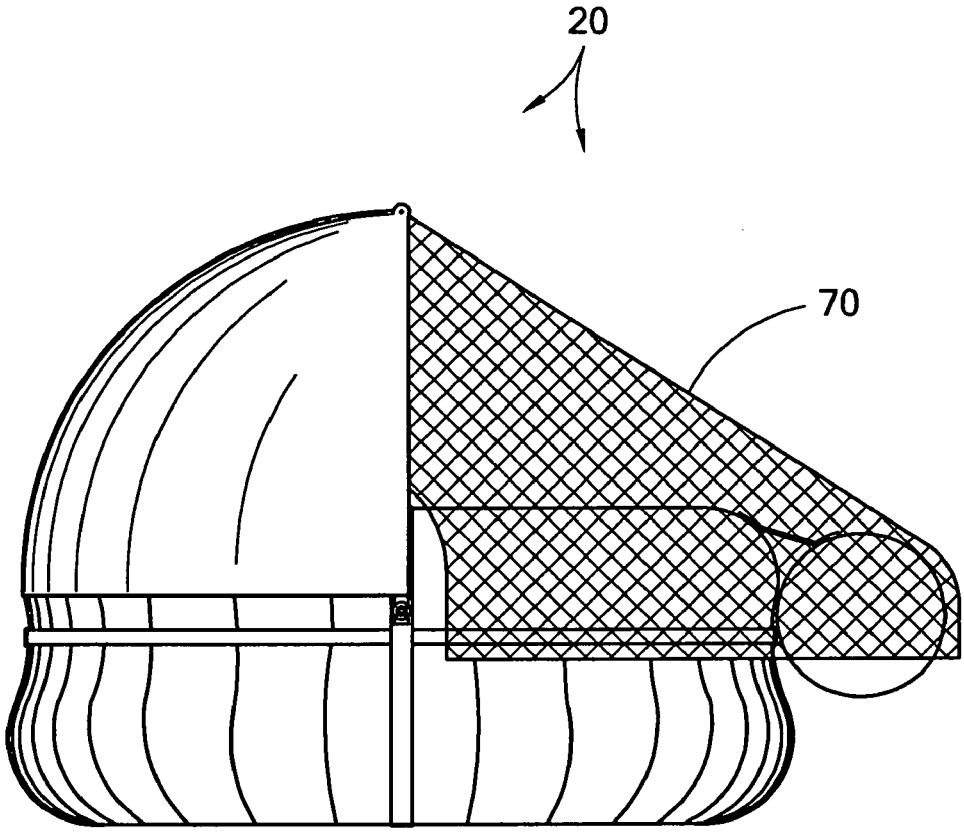
FIG. 13 is an side elevational view of the blind configured as in FIG. 12.
Figure 14:
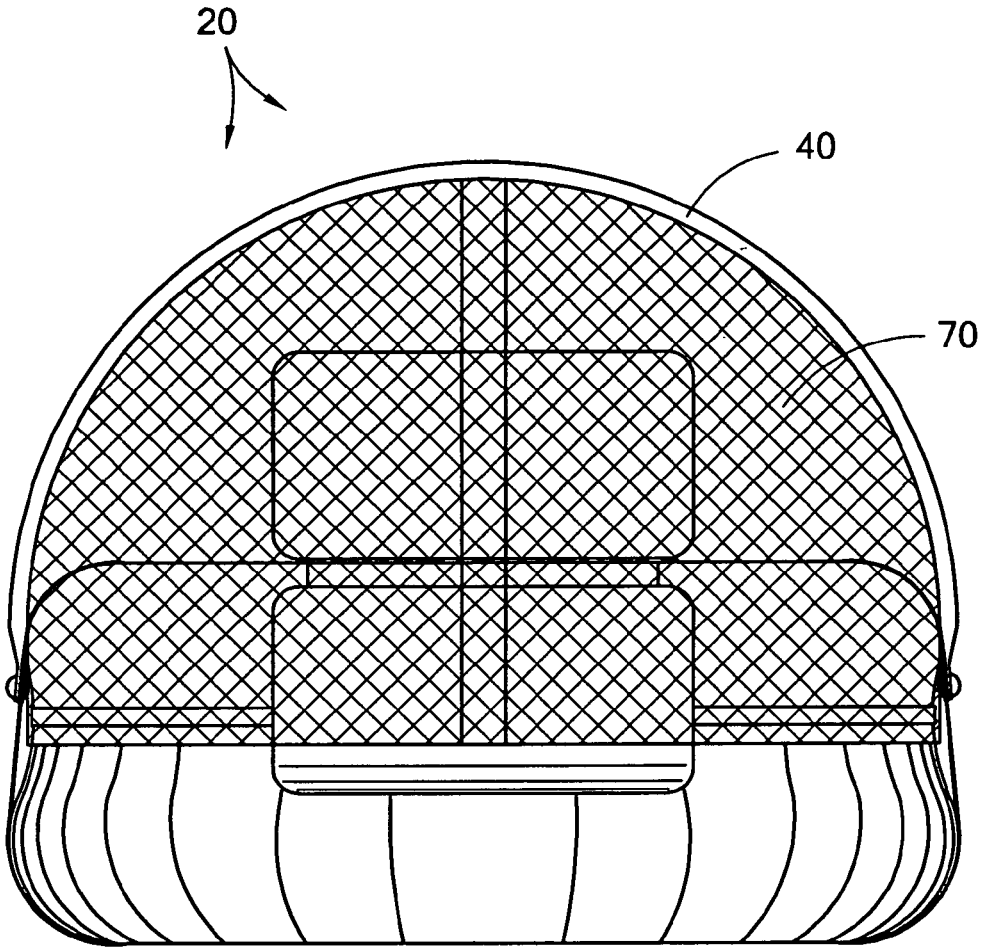
FIG. 14 is a frontal elevational view of the blind configured as illustrated in FIGS. 12-13; and, FIG. 15 is a top plan view of the blind configured as in FIGS. 12-14.
Figure 15:
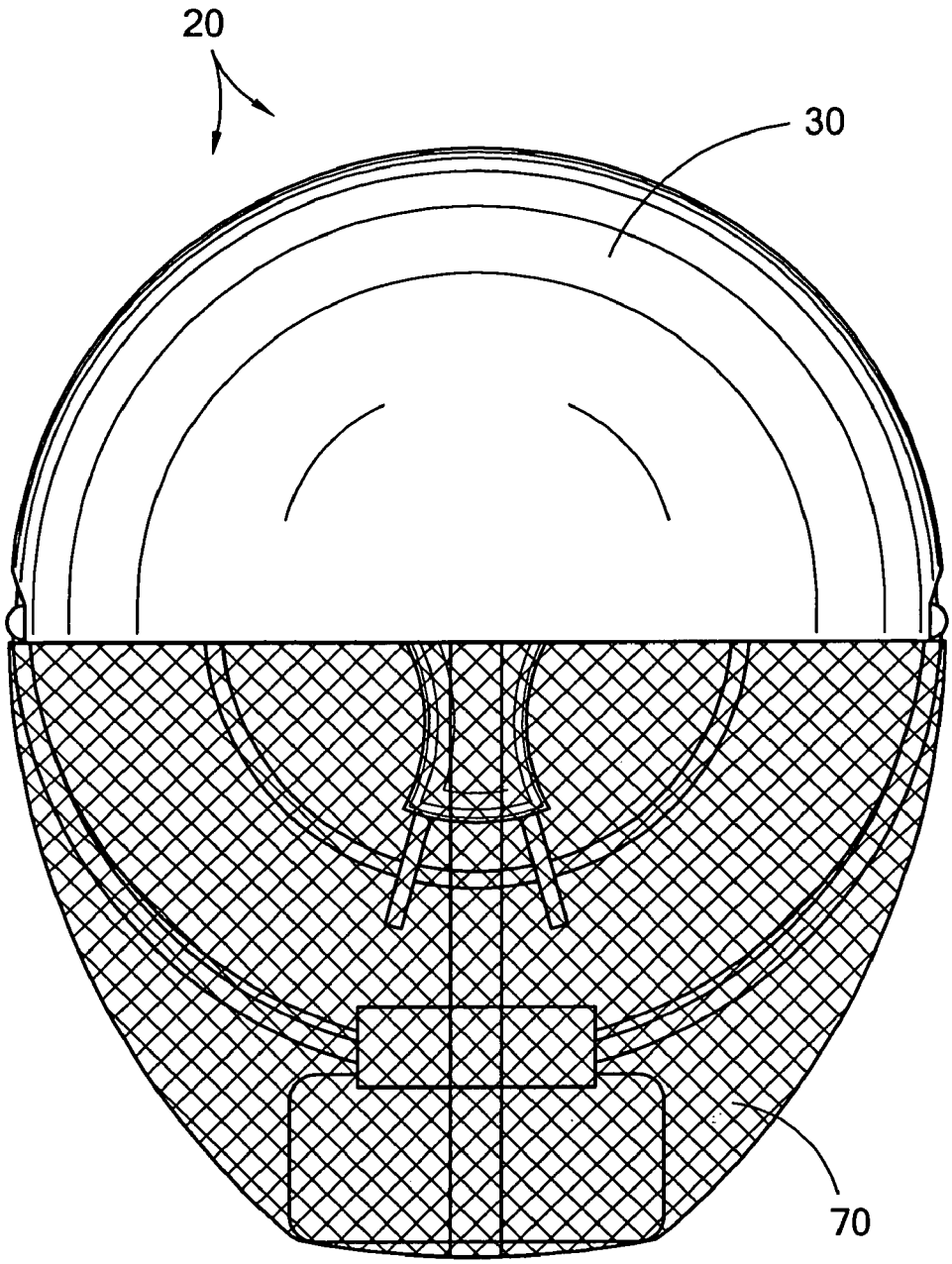

Similarly, in the best mode there is a headrest 34 at the rear of the float 20. Headrest 34 is preferably cylindrical, and it is similar in design to support 32. It is attached by a flap 39 (FIGS. 1, 4), that is permanently sewn to the fabric 21 covering the inner tubes. It is disposed in the region beneath the optional canopy 30. Headrest 34 also includes an inflatable air bladder 41 (FIGS. 10, 11). Like the support 32, headrest 34 can be moved into the interior, in the direction of movement generally indicated by the dashed lines in FIG. 8. By releasing some air from its bladder, the headrest can be nested against the users back, providing support against the inner periphery of the inner tubes of the float. In this manner it functions as a backrest.

The encircling juncture region 29 is best seen in FIGS. 2 and 3. This depressed volume is formed at the juncture between the stacked inner tubes 24 and 25. It will be appreciated by the viewer that these tubes are covered by canvas fabric 21, as most evident in the isometric and elevational views. Structural integrity is enhanced by the combination of the belt 27, that is anchored and seated within the depressed region 29 (i.e., FIG. 3) to tension fabric 21, and the spaced apart frame loops 26 that bind the inner tubes together in coaxial, stacked relation.

Figure 5:
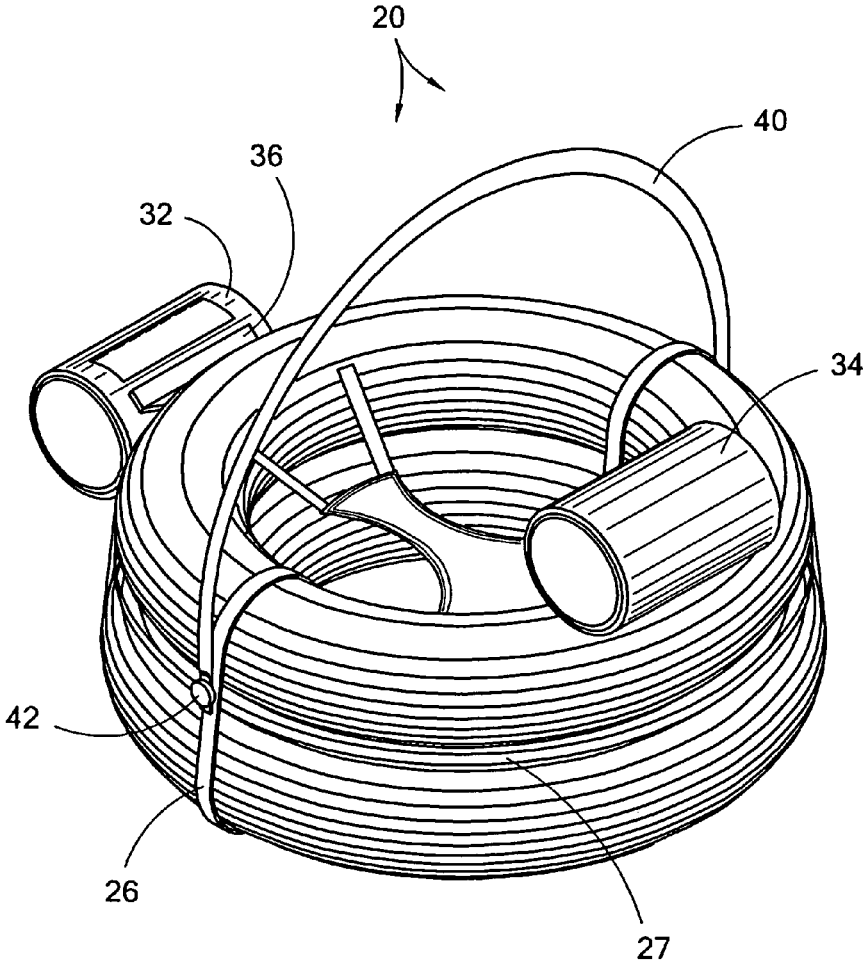
FIG. 5 is a rear isometric view of my blind with the canopy omitted.

As best seen in FIGS. 1, 2 and 5, the collapsible canopy 30 is mounted and suspended above the float 20 by a semicircular hoop 40, whose opposite lower ends are fastened to a frame loop 26 to form hinges. As viewed in FIG. 5, the lowermost slotted ends of the hoop 40 are penetrated by a suitable knurled knob 42 (or other fastener) from which a conventional threaded stem (not shown) projects. The stem threadably penetrates an adjacent frame loop 26 and is threadably anchored therewithin over the belt 27. Canopy 30 is collapsed by loosening the knob 42 and rotating it about the hinge formed by the ends of hoop 40.

With reference now directed to FIGS. 12-15, the best mode of the float 20 includes a net 70 that covers the user and camouflages him or her. Also, it protects against insects such as mosquitoes, flies and other pests while allowing waterfowl viewing. It is suspended between the top of canopy loop 40 and the underside of the deployed canopy 30, and drawn forwardly until it suitably covers the front of the float and rest 32.

From the foregoing, it will be seen that this invention is one well adapted to obtain all the ends and objects herein set forth, together with other advantages that are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A float for outdoorsman, the float comprising:

a front and rear;

a base comprising a pair of stacked, coaxially aligned inner tubes;

means for covering said base;

a depressed annular region formed at the junction of the stacked tubes that encircles the float, the annular region concentric with said tubes;

an open center at the middle of the base;

a seat disposed within the center for supporting a user;

an encircling belt that is concentric with and coaxial relative to the tubes and which occupies said depressed annular region to tension the float, the belt tensioning said means for covering said base;

at least one frame loop encircling the base and the tubes;

a movable cylindrical support normally disposed at the front of the float which can be repositioned as desired;

a generally cylindrical headrest normally disposed at the rear of the float that can be repositioned as desired;

a hoop that is selectively deployable over the float, the hoop having ends that are attachable to said at least one frame loop to form a hinged connection; and, a collapsible canopy supported by the hoop.

2. The float as defined in claim 1 wherein the headrest is attached to the float by a flexible flap.

3. A floating blind for fisherman and hunters, the blind comprising:

a front and a rear;

a base comprising a pair of stacked, coaxially aligned, generally toroidal inner tubes;

a depressed annular region formed at the junction of the inner tubes that encircles the float and is concentric with respect to said tubes;

an open center at the middle of the base;

a seat disposed within the center for supporting a user;

a covering tightly enshrouding the float;

an enhanced frame comprising an encircling belt that is concentric and coaxial relative to the tubes, the belt tightening the base by drawing the covering tightly towards the depressed region, the belt occupying said annular region and compressing said covering;

a movable cylindrical support normally disposed at the front of the float which can be moved into the float center as desired, wherein the support is attached to the float by a flexible flap;

a generally cylindrical headrest normally disposed at the rear of the float that can be moved into the float center as desired to form a backrest, the headrest attached to the float by a flexible flap;

at least one frame loop encircling the base;

a hoop that is selectively deployable over the blind, the hoop having ends that are attachable to at least one frame loop; and, a canopy supported by the hoop.

4. A floating blind for fisherman and hunters, the blind comprising:

a front and a rear;

inner tube means for floating the blind;

an open center at the middle of the blind;

an adjustable seat disposed within the center for supporting a user;

a covering tightly enshrouding the float;

a frame comprising an encircling belt that is concentric and coaxial relative to the tube means, the belt tightening the covering;

at least two spaced apart frame loops;

a hoop that is selectively deployable over the blind, the hoop having ends that are attachable to said frame loops and hinged thereby;

a removable, collapsible canopy supported by the hoop;

a movable cylindrical support normally disposed at the front of the float which can be moved into the float center as desired, wherein the support is attached to the float by a flexible flap; and, a generally cylindrical headrest normally disposed at the rear of the float that can be moved into the float center as desired to form a backrest, the headrest attached to the float by a flexible flap.

5. The blind as defined in claim 4 wherein the support and the headrest both contain air bladders that can be adjusted in pressure.

* * * * *